US009932717B2

(12) United States Patent
Stark

(10) Patent No.: US 9,932,717 B2
(45) Date of Patent: Apr. 3, 2018

(54) PILE FOR TOWER FOUNDATION

(71) Applicant: N. Daniel W. Stark, Vancouver, WA (US)

(72) Inventor: N. Daniel W. Stark, Vancouver, WA (US)

(73) Assignee: STARK INNOVATIVE LLC, Vancouver, WA (US)

( * ) Notice: Subject to any disclaimer, the term of this patent is extended or adjusted under 35 U.S.C. 154(b) by 0 days.

(21) Appl. No.: 15/060,561

(22) Filed: Mar. 3, 2016

(65) Prior Publication Data

US 2016/0258125 A1 Sep. 8, 2016

Related U.S. Application Data

(60) Provisional application No. 62/127,644, filed on Mar. 3, 2015.

(51) Int. Cl.
*E02D 5/28* (2006.01)
*E02D 5/48* (2006.01)
(Continued)

(52) U.S. Cl.
CPC ..... *E02D 5/48* (2013.01); *E02D 5/24* (2013.01); *E02D 5/28* (2013.01); *E02D 27/42* (2013.01); *E04C 3/32* (2013.01)

(58) Field of Classification Search
CPC .... E02D 5/24; E02D 5/28; E02D 5/48; E04C 3/07
See application file for complete search history.

(56) References Cited

U.S. PATENT DOCUMENTS 1,457,303 A * 6/1923 Higgins ..... E04C 3/07 52/842
2,670,061 A * 2/1954 McMahon ..... E04C 3/07 52/377

(Continued)

FOREIGN PATENT DOCUMENTS

EP 2243648 B1 8/2011
WO 2011135054 11/2011
WO WO-2011135054 A2 * 11/2011 ..... E04C 3/07

OTHER PUBLICATIONS

International Search Report and Written Opinion for International Application No. PCT/US16/20781 dated Aug. 16, 2016.

*Primary Examiner* — Tara Mayo-Pinnock
(74) *Attorney, Agent, or Firm* — Kunzler, PC

(57) ABSTRACT

A foundation pile includes a first flange section, a second flange section, and a web section. The first flange section, second flange section, and web section are formed from a single length of material and each comprises at least two layers of the material. A second end of the length of material is wrapped 180-degrees around a first end of the length of material to form a wrapped-around portion in the length of material and a three-layered overlapping region in the first flange section. One or more tabs protrude perpendicularly from the first end of the length of material, such that the tabs are not bent relative to the first end. The one or more tabs extend into respective one or more slots in the length of material adjacent the second end of the length of material. The respective one or more slots are formed in the wrapped-around portion.

3 Claims, 13 Drawing Sheets

(51) Int. Cl.

| | |
|---|---|
| ***E02D 5/24*** | (2006.01) |
| ***E04C 3/32*** | (2006.01) |
| ***E02D 27/42*** | (2006.01) |

(56) References Cited

U.S. PATENT DOCUMENTS

| | | | | |
|---|---|---|---|---|
| 2,747,704 | A * | 5/1956 | Gorey | E04C 3/07 52/377 |
| 5,373,679 | A | 12/1994 | Goleby | |
| 5,860,363 | A | 1/1999 | Duncan et al. | |
| 7,615,073 | B2 | 11/2009 | Deacon et al. | |
| 8,720,866 | B1 | 5/2014 | Gibbs | |
| 2006/0283139 | A1 | 12/2006 | Wall | |
| 2007/0130873 | A1* | 6/2007 | Fisher | E04B 2/18 52/596 |
| 2008/0155935 | A1 | 7/2008 | Raheel et al. | |
| 2012/0060443 | A1* | 3/2012 | Vernon | E04C 3/29 52/834 |
| 2012/0328898 | A1 | 12/2012 | Strickland et al. | |

* cited by examiner

PILE FOR TOWER FOUNDATION

CROSS-REFERENCE TO RELATED APPLICATION

This application claims priority to U.S. Provisional Patent Application No. 62/127,644, filed Mar. 3, 2015, which is incorporated herein by reference.

FIELD

The present application relates generally to structural piles, and more specifically to piles for stabilizing tower foundations.

BACKGROUND

Piles are often implemented to establish and stabilize foundations for structures that are designed to maintain heavy loads, or for structures that are constructed in loose or unstable ground. For example, foundation piles can be used in the construction of bridges, docks, and other structures that require a footing in sandy and/or muddy terrain. Foundation piles can further be used to reinforce conventional foundations against anticipated earthquakes, floods, tornadoes, and other natural disasters. Still further, foundation piles are often used to provide a stable foundation for sky-scrapers, towers, and other large buildings that require a substantial footing.

While foundation piles can be constructed according to various techniques and can have various structural configurations, some foundation piles often resemble I-beams that are frequently used in construction to support large loads while spanning large horizontal distances. Conventional metal foundation piles and metal I-beams are often constructed using a metal rolling technique (e.g., hot rolling and cold rolling techniques). Conventional metal rolling techniques, however, are often only capable of efficiently producing flat sheets that are welded together to form foundation piles and I-beams with the traditional I-shaped cross-sections. In other words, foundation piles constructed using conventional metal rolling techniques are limited in their flange configurations and often have flanges that are double layered. While traditional flange configurations and double-layered flanges may be acceptable in certain implementations, the limitations of conventional foundation piles and the associated manufacturing methods render certain foundation pile applications expensive and/or inefficient to implement.

SUMMARY

The subject matter of the present application has been developed in response to the present state of the art, and in particular, in response to the problems of and needs from conventional tower foundations that have not yet been fully solved by currently available systems. Generally, the subject matter of the present application has been developed to provide a tower foundation system, apparatus, and method that overcome at least some of the above-discussed shortcomings of prior art systems.

According to one embodiment, disclosed herein is a foundation pile that includes a double-layered web and single-layered flanges. The double-layers web has a first web segment and a second web segment coupled together. The first web segment forms a first exterior lateral surface of the foundation pile and the second web segment forms a second exterior lateral surface of the foundation pile. The double-layered web includes front and rear edges. The single-layers flanges include a first front flange segment extending laterally from the front edge of the first web segment, a second front flange segment extending laterally from the front edge of the second web segment (the first front flange segment and the second front flange segment forming a front flange surface), a first rear flange segment extending laterally from the rear edge of the first web segment, and a second rear flange segment extending laterally from the rear edge of the second web segment (the first rear flange segment and the second rear flange segment forming a rear flange surface).

According to one implementation, the single layered flange segments extend outward from the double-layered web in a direction that is perpendicular to the first and second exterior lateral surfaces. In another implementation, the single-layered flange segments extend outward from the double-layered web in a direction that is non-perpendicular to the first and second exterior lateral surfaces. In yet another implementation, the front flange surface is wider than the rear flange surface.

In one implementation, at least one of the single-layered flanges has a flange stiffener extending from the flange in a direction that is non-parallel to the flange. In another implementation, the first and second web segments are coupled together using mechanical fasteners. In yet another implementation, the first and second web segments are coupled together using a chemical bonding agent.

Also disclosed herein is one embodiment of a method for manufacturing a foundation pile. The method includes providing a first pile member that has a first web segment, a first front flange segment, and a first rear flange segment. The method further includes providing a second pile member that has a second web segment, a second front flange segment, and a second rear flange segment. Still further, the method also includes coupling the first web segment of the first pile member to the second web segment of the second pile member.

Disclosed herein, according to one embodiment, is a foundation pile that includes a first pile member that has a first web segment, a first front flange segment, and a first rear flange segment and a second pile member that has a second web segment, a second front flange segment, and a second rear flange segment. The first web segment of the first pile member and the second web segment of the second pile member are coupled together. In one implementation, the first pile member is a mirror image of the second pile member.

Also disclosed herein is one embodiment of a foundation pile that includes a first flange section, a second flange section spaced apart from the first flange section, and a web section extending between the first and second flange sections. The first flange section, second flange section, and web section are formed from a single length of material and the first flange section, second flange section, and web section each have at least two layers of the material.

In one implementation, a second end of the length of material is wrapped around a first end of the length of material to form a three-layered overlapping region in one of the first and second flange segments. In such an implementation, the first flange section has first and second end portions and the second flange section has third and fourth end portions. In such an implementation, the overlapping region may be at one of the first, second, third, and fourth end portions. In another implementation, the first flange section has first and second end portions and the second flange section has third and fourth end portions, with one of the first, second, third, and fourth end portions being a bulbous region. The bulbous region is where a distance between the two layers of material in the bulbous region is greater than a distance between the two layers of material in the flange sections. In such an implementation, the overlapping region is at another of the first, second, third, and fourth end portions. In yet another implementation, the first flange section has first and second end portions and the second flange section has third and fourth end portions. The overlapping region may be at one of the first, second, third, and fourth end portions and a bulbous region may be at the other three of the first, second, third, and fourth end portions.

In one implementation, one or more tabs protrude from the first end of the length of material and extend into one or more respective slots in the length of material adjacent the second end of the length of material. In another implementation, the one or more tabs protrude from the first end of the length of material in a direction parallel to the flange sections such that the respective slots are disposed in a wrapped-around portion of the length of material. In one implementation, the foundation pile is free of a bonding agent between the layers of the material.

According to another implementation, the length of material includes a first end abutting a second end to form a first layer of the at least two layers of the web section. In such an implementation, the ends of the length of material include one or more tabs that extend perpendicular relative to the web section into respective slots formed in a second layer adjacent the first layer of the at least two layers of the web section.

Also disclosed herein is one embodiment of a method for manufacturing a foundation pile. The method includes providing a length of material comprising a first end and a second end and bending the length of material multiple times at different locations to form a foundation pile with a web section and two flange sections. The web section and the two flange sections each has at least two layers of the length of material. In one implementation, bending the length of material includes bending the length of material 12 times.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

Figure 1A:
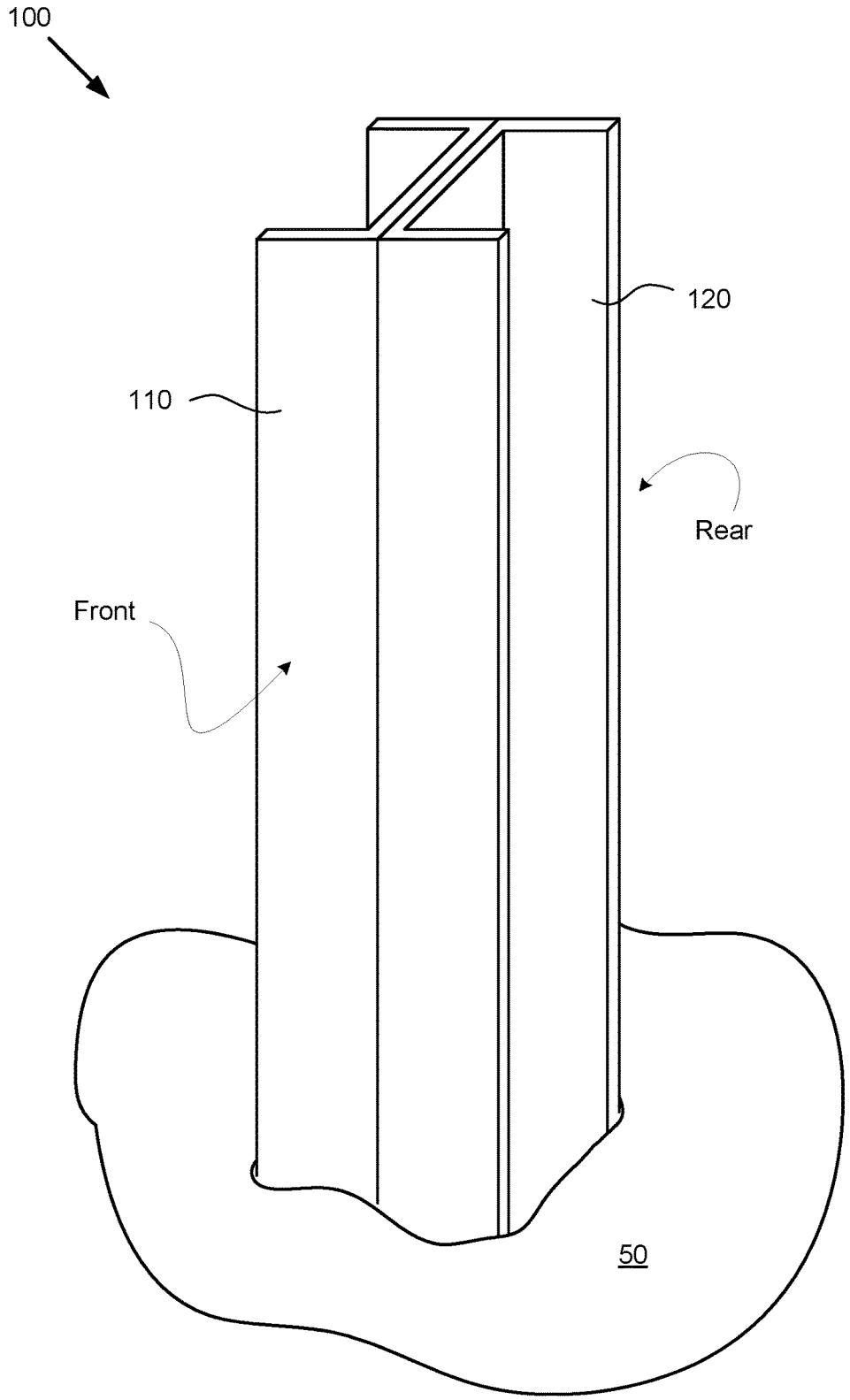
FIG. 1A is a schematic front perspective view of one embodiment of a foundation pile partially driven into the ground.

FIG. 1A is a front perspective view of one embodiment of a foundation pile 100 driven partially into the ground 50. Throughout the present disclosure, the term foundation pile is used to refer to a beam that is implemented to provide a foundation and/or a footing for structures. Foundation piles may be constructed from various materials, such as metal, wood, composite, reinforced cement, etc. While foundation piles may also be used (and possibly adapted for us) as I-beams to support a load across a horizontal span, the piles of the present disclosure are generally configured and intended for use in structural foundations. FIG. 1A also labels each flange surface as either a "front" surface or "rear" surface. These orientation labels, "front" and "rear", are used throughout the disclosure to describe and identify various segments of the web and flanges. However, depending on the application and the viewing perspective, the front may actually be the rear, and vice-versa.

As background, some piles generally have a central panel of material, such as steel, that is disposed intermediate two other panels that extend laterally from the central panel, such as at opposing ends of the central panel. The central panel is referred to as the web and the two other panels extending laterally from the web are referred to as flanges. The embodiment of the foundation pile 100 depicted in FIG. 1A includes a first pile member 100 and a second pile member 120 that are coupled together. In the illustrated embodiment, each of the first and second pile members 110, 120 depicted in FIG. 1A is generally C-shaped or U-shaped. The first and second pile members 110, 120 are configured to be coupled together so as to form a pile that has a double-layered web 210 and single-layered flanges 220. Additional details and embodiments relating to the possible orientations and configurations of the flanges (i.e., pile members with cross-sectional shapes other than U-shaped or C-shaped) are included below with reference to FIGS. 2A-3D.

Figure 1B:
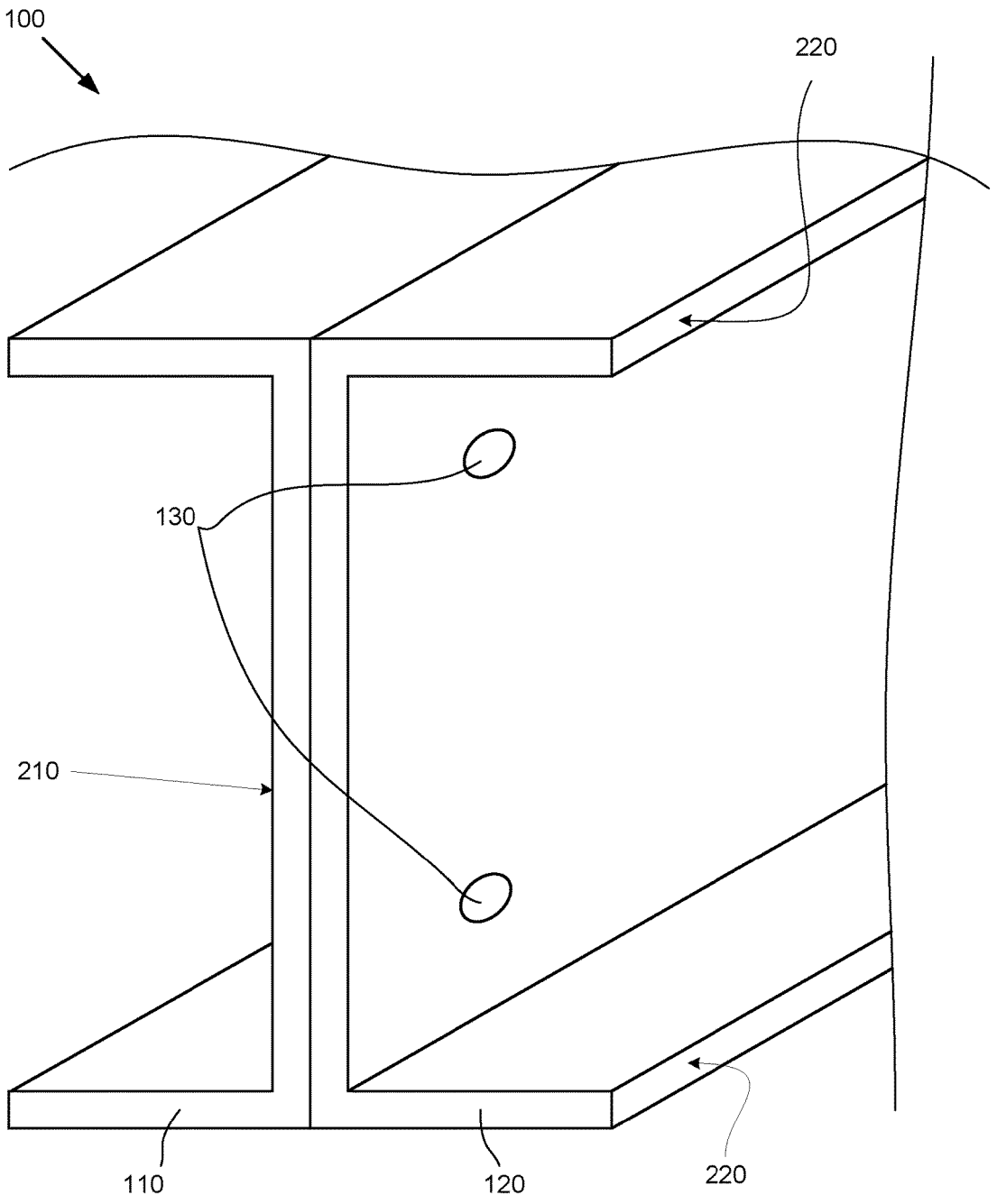
FIG. 1B is a schematic top partial perspective view of one embodiment of a foundation pile showing a first and second pile member coupled together.

FIG. 1B is a top partial perspective view of one embodiment of a foundation pile 100 showing the first and second pile members 110, 120 coupled together to form a double layered web 210 and single layered flanges 220. FIG. 1B also depicts two mechanical fasteners 130 extending through the double layered web 210 to hold or fasten the first pile member 110 to the second pile member 120. The segments and sections of the first and second pile members 110, 120 are described below with reference to FIG. 2A. As described above in the background section and as described in greater detail below with reference to FIGS. 2A-3D, conventional piles are often structurally limited, due in-part to cost and efficiency constraints of conventional manufacturing processes, and have limited application adaptability. For example, some conventional piles separately form the flanges and then weld the flanges to the central web, which may weaken the overall strength of the pile. Another conventional pile has at least one flange that is double layered. While in certain applications a double layered flange may be desired, in other applications it is desirable to have single layered flanges with a double layered web (i.e., certain foundation pile applications).

In contrast to conventional piles, the flanges of the piles of the present disclosure are co-formed with the central web. In other words, the flanges 220 of the pile 100 are not separately formed and welded to the central web, but rather are formed with the central web from a single sheet of material, that is bent to form the flanges.

The mechanical fasteners 130 holding the two pile members 110, 120 together may be rivets, bolts, clasps, pins, etc. The number, distribution, and placement of the mechanical fasteners may vary according to the specifics of a given application. In one embodiment, the first pile member 110 and the second pile member 120 are mechanically coupled together near the ends of the pile. In another embodiment, a single mechanical fastener or a single set of mechanical fasteners are disposed near the longitudinal midline of the pile. In one embodiment, the first and second pile members 110, 120 may be welded together to form the double layered web 210. One of ordinary skill in the art will recognize other mechanical fastener assemblies and configurations for coupling the first and second pile members 110, 120 together that fall within the scope of the present disclosure.

In another embodiment, chemical bonding agents may be implemented to join the two pile members 110, 120 together, whether in conjunction with mechanical fasteners or exclusive thereof. Chemical bonding agents, such as adhesives, epoxies, resins, etc., may be strategically placed in predetermined locations along the double layered web 210 to hold the two pile members 110, 120 together or to enhance the strength of an existing coupling.

Figure 2A:
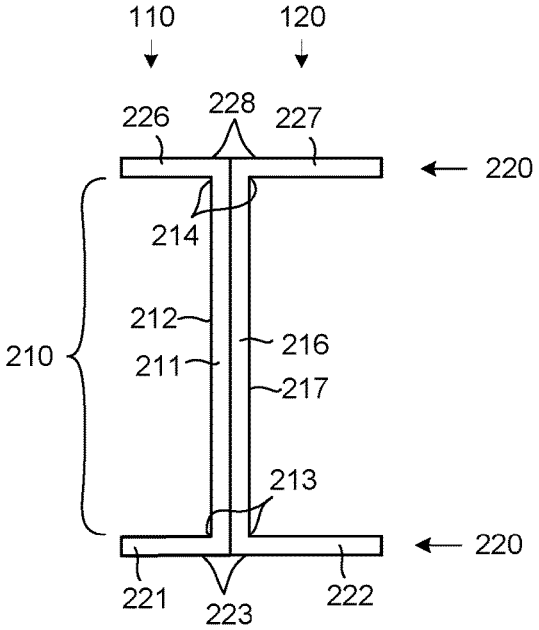
FIG. 2A is a schematic cross-sectional view of one embodiment of a foundation pile with a double layered web and single layered flanges, specifically showing one embodiment of a foundation pile with non-symmetrical first and second pile members.

FIG. 2A is a cross-sectional view of one embodiment of a foundation pile with a double layered web 210 and single layered flanges 220, specifically showing one embodiment of a foundation pile with non-symmetrical first and second pile members 110, 120. The double layered web 210 is formed from a first web segment 211 of the first pile member 110 and a second web segment 216 of the second pile member 120. As discussed, these two segments 211, 216 may be coupled together using at least one of a mechanical fastener, a chemical bonding agent, and weldment. The joined first and second web segments 211, 216 also form first and second exterior lateral surfaces 212, 217 of the foundation pile. The double layered web also has a front edge 213 and a rear edge 214.

The modifiers "first" and "second", as used throughout the present disclosure, refer to the two lateral sides of the foundation pile. In other words, the segments and components of the first pile member 110 (the left side of the foundation pile) include the modifier "first" in their respective component names while the segments and components of the second pile member 120 (the right side of the foundation pile) include the modifier "second" in their respective component names.

The single layered flanges 220 included flange segments from both the first and second pile members 110, 120 to form a front flange surface 223 and a rear flange surface 228. The first pile member 110 includes a first front flange segment 221 and a first rear flange segment 226 that extend from the front edge 213 and the rear edge 214, respectively, of the first web segment 211. The second pile member 120 includes a second front flange segment 222 and a second rear flange segment 227 that extend from the front edge 213 and the rear edge 214, respectively, of the second web segment 216. In other words, the front flange surface 223 is formed from the first front flange segment 221 and the second front flange segment 222 and the rear flange surface 228 is formed from the first rear flange segment 226 and the second rear flange segment 227.

As depicted in FIG. 2A, the length of the first flange segments 221, 226 of the first pile member 110 may be comparatively shorter than the lengths of the second flange segments 222, 227 of the second pile member 120. In other words, in one embodiment the first and second pile members 110, 120 are symmetrical (i.e., mirror images across a plane extending between the double layered web) while in another embodiment the first and second pile members 110, 120 may be non-symmetrical (as depicted in FIG. 2A). The non-symmetrical nature of the first and second pile members 110, 120 may not be exclusively based on the lengths of the respective flange segments, but may be based on the extension angle of the flange segments. In other words, the first front flange segment 221 may have a length and/or an extension angle from the first web segment 211 that differs from the length and/or extension angle of the second front flange segment 222.

The reference numbers for the first and second pile members 110, 120 and the reference numbers for the double layered web 210 and single layered flanges 220 will not be included in the remaining figures to avoid obscuring the disclosure and to prevent excessive clutter in the figures. Additionally, various other components may not be labeled in the embodiments depicted in the remaining figures for the same reason of maintaining clear and concise depictions. If an element or a component includes an accompanying reference number in the paragraphs describing a certain figure but the accompanying reference number does not appear in the certain figure, previous figures may be referenced to find similar and/or analogous components showing the referenced element/component.

Figure 2B:
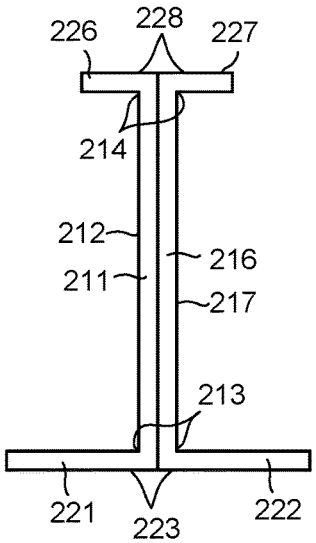
FIG. 2B is a schematic cross-sectional view of another embodiment of a foundation pile with a double layered web and single layered flanges, specifically showing one embodiment of a foundation pile with non-symmetrical front and rear flange surface widths.

FIG. 2B is a cross-sectional view of another embodiment of a foundation pile with a double layered web 210 and single layered flanges 220, specifically showing one embodiment of a foundation pile with non-symmetrical front and rear flange surfaces. As depicted, the front flange surface 223 may be comparatively longer than the rear flange surface 228, or vice-versa. In other embodiments, the foundation pile may only include flange segments on either the front or rear edge 213, 214 of the double layered web 210. In yet another embodiment, the extension angle of the flange segments 220 from the double layered web 210 may contribute to the non-symmetrical nature of the front and rear flange surfaces 223, 228.

In other words, the foundation pile may be substantially symmetrical with respect to a plane extending between the first and second web segments 211, 216, or substantially symmetrical with respect to a longitudinal plane traversing the web midway between the front and rear flange surfaces 223, 228 (or symmetric about both planes). In one embodiment, the configuration where the foundation pile is substantially symmetrical with respect to a longitudinal plane traversing the web midway between the front and rear flange surfaces 223, 228 is especially beneficial because conventional piles and I-beams, with double layered-flanges, are generally not symmetrical about such a plane. In another embodiment, the foundation pile may be non-symmetrical based on the extension angles of the flange segments, the extension angle of the flange stiffeners (described below with reference to FIGS. 3A-3D), and/or the various lengths and proportions of the various elements and components.

Figure 2C:
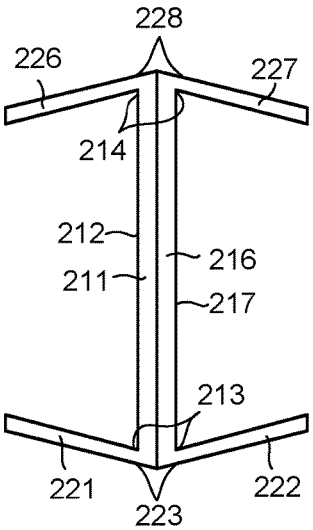
FIG. 2C is a schematic cross-sectional view of another embodiment of a foundation pile with a double layered web and single layered flanges, specifically showing one embodiment of a foundation pile with single layered flanges that extend non-perpendicularly from the double layered web.

FIG. 2C is a cross-sectional view of another embodiment of a foundation pile with a double layered web 210 and single layered flanges 220, specifically showing one embodiment of a foundation pile with single layered flanges 220 that extend non-perpendicularly from the double layered web 210. As previously described, while the extension angle of the flange segments 220 from the front and rear edges 213, 214 of the web 210 may be a substantially right angle (i.e., flange extending perpendicular to the web as in conventional I-beams), in other embodiments the flange segments 220 may extend from the web 210 in non-perpendicular directions. For example, FIG. 2C shows a first pile member 110 that includes a first front flange segment 221 and a first rear flange segment 226 that extend from the front and rear edges 213, 214, respectively, of the web 210 at acute angles. In the depicted embodiment, the second pile member 120 has the mirror image flange configuration. In such an embodiment, the front and rear flange surfaces 223, 228 do not occupy a plane but instead have a wedge-like structure. Such a configuration may be selected according to the specifics of a given application. For example, foundation piles with inwardly extending flange segments, as depicted in FIG. 2C, may be well-suited to be driven into and secured in certain types of ground/terrain.

Figure 2D:
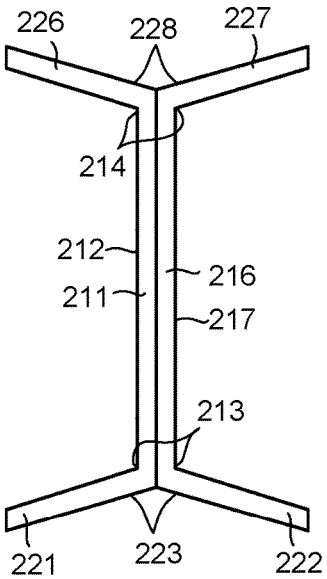
FIG. 2D is a schematic cross-sectional view of another embodiment of a foundation pile with a double layered web and single layered flanges, specifically showing another embodiment of a foundation pile with single layered flanges that extend non-perpendicularly from the double layered web.

FIG. 2D is a cross-sectional view of another embodiment of a foundation pile with a double layered web 210 and single layered flanges 220, specifically showing another embodiment of a foundation pile with single layered flanges 220 that extend non-perpendicularly from the double layered web 210. FIG. 2D shows a first pile member 110 that includes a first front flange segment 221 and a first rear flange segment 226 that extend from the front and rear edges 213, 214, respectively, of the web 210 at obtuse angles. In the depicted embodiment, the second pile member 120 has the mirror image flange configuration. In such an embodiment, the front and rear flange surfaces 223, 228 do not occupy a plane but instead have a trough-like structure and shape. Such a configuration may be selected according to the specifics of a given application. For example, foundation piles with outwardly extending flange segments, as depicted in FIG. 2C, may be well-suited to be driven into and secured in certain types of ground/terrain.

Figure 3A:
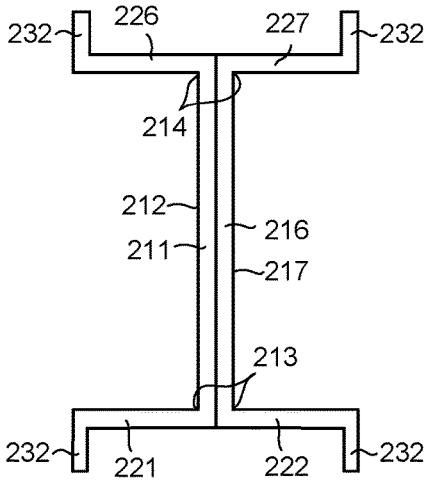
FIG. 3A is a schematic cross-sectional view of one embodiment of a foundation pile with a double layered web and single layered flanges, specifically showing one embodiment of flange stiffeners.

FIG. 3A is a cross-sectional view of one embodiment of a foundation pile with a double layered web 210 and single layered flanges 220, specifically showing one embodiment of flange stiffeners 232. A flange stiffener 232 extends in a direction that is non-parallel from the direction of the flange segment. In one embodiment, the flange stiffeners 232 may be integrated with the flange segments (i.e., formed of the same, unitary material). The flange stiffeners 232 may be included to increase the structural rigidity and/or strength of the flange segments.

In another embodiment, the flange stiffeners 232 may be for reasons other than structural rigidity, such as to create a foundation pile cross-section that is configured for a specific application. Thus, the flange stiffeners 232 may be implemented as distal portions of the flange segments that extend in a direction that is different from the original extension direction of a proximal portion of the flange segments. While FIGS. 3A-3D only show embodiments with a single flange stiffener 232 on each flange segment, those of ordinary skill in the art will recognize that multiple flange stiffeners may be included on each flange segment, whether in series or in parallel (i.e., multiple stiffeners may extend in multiple directions from a single location on the flange segment). Additionally, certain flange segments may incorporate flange stiffeners while other flange segments on the same foundation pile may not have any flange stiffeners.

Figure 3B:
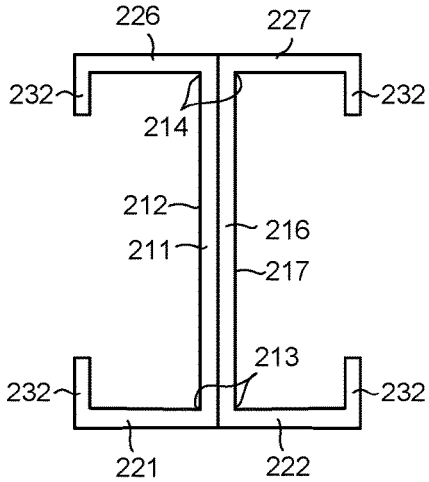
FIG. 3B is a schematic cross-sectional view of one embodiment of a foundation pile with a double layered web and single layered flanges, specifically showing another embodiment of flange stiffeners.
Figure 3C:
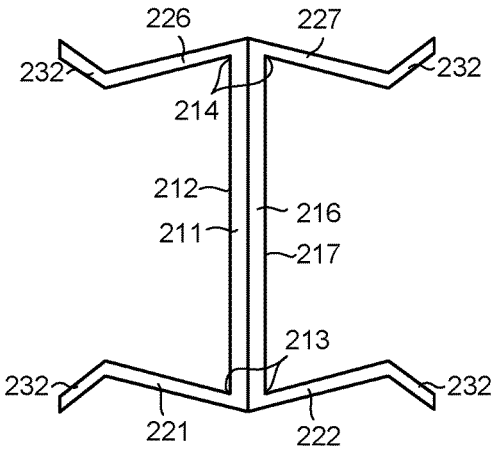
FIG. 3C is a schematic cross-sectional view of one embodiment of a foundation pile with a double layered web and single layered flanges, specifically showing another embodiment of flange stiffeners.
Figure 3D:
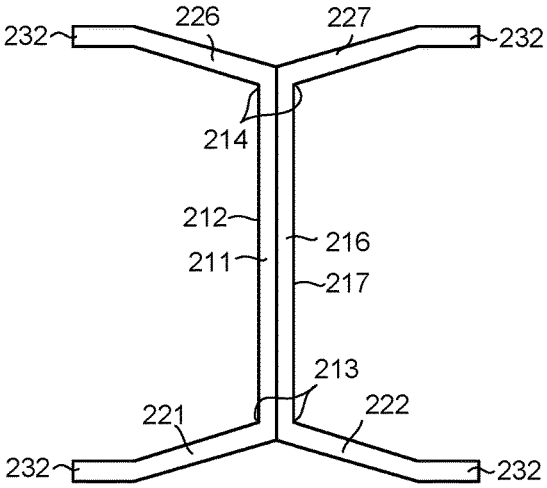
FIG. 3D is a schematic cross-sectional view of one embodiment of a foundation pile with a double layered web and single layered flanges, specifically showing yet another embodiment of flange stiffeners.

In the embodiment depicted in FIG. 3A, the flange stiffeners 232 extend outward at right angles from the flange segments 221, 222, 226, 227. FIG. 3B is a cross-sectional view of another embodiment of a foundation pile with a double layered web 210 and single layered flanges 220, specifically showing flange stiffeners 232 extending inward at right angles from the flange segments 221, 222, 226, 227. FIGS. 3C and 3D are cross-sectional views of other embodiments of foundation piles that each have flange stiffeners 232 extending from the flange segments 221, 222, 226, 227 in directions that are non-perpendicular to the flange segments. FIG. 3C shows flange segments 221, 222, 226, 227 extending from front and rear edges 213, 214 of the web at acute extension angles (inward) with flange stiffeners 232 extending from the distal ends of the flange segments 221, 222, 226, 227 while FIG. 3D shows flange segments 221, 222, 226, 227 extending from front and rear edges 213, 214 of the web at obtuse extension angles (outward) with flange stiffeners 232 extending from the distal ends of the flange segments 221, 222, 226, 227 at an angle that is orthogonal to the web.

Figure 4:
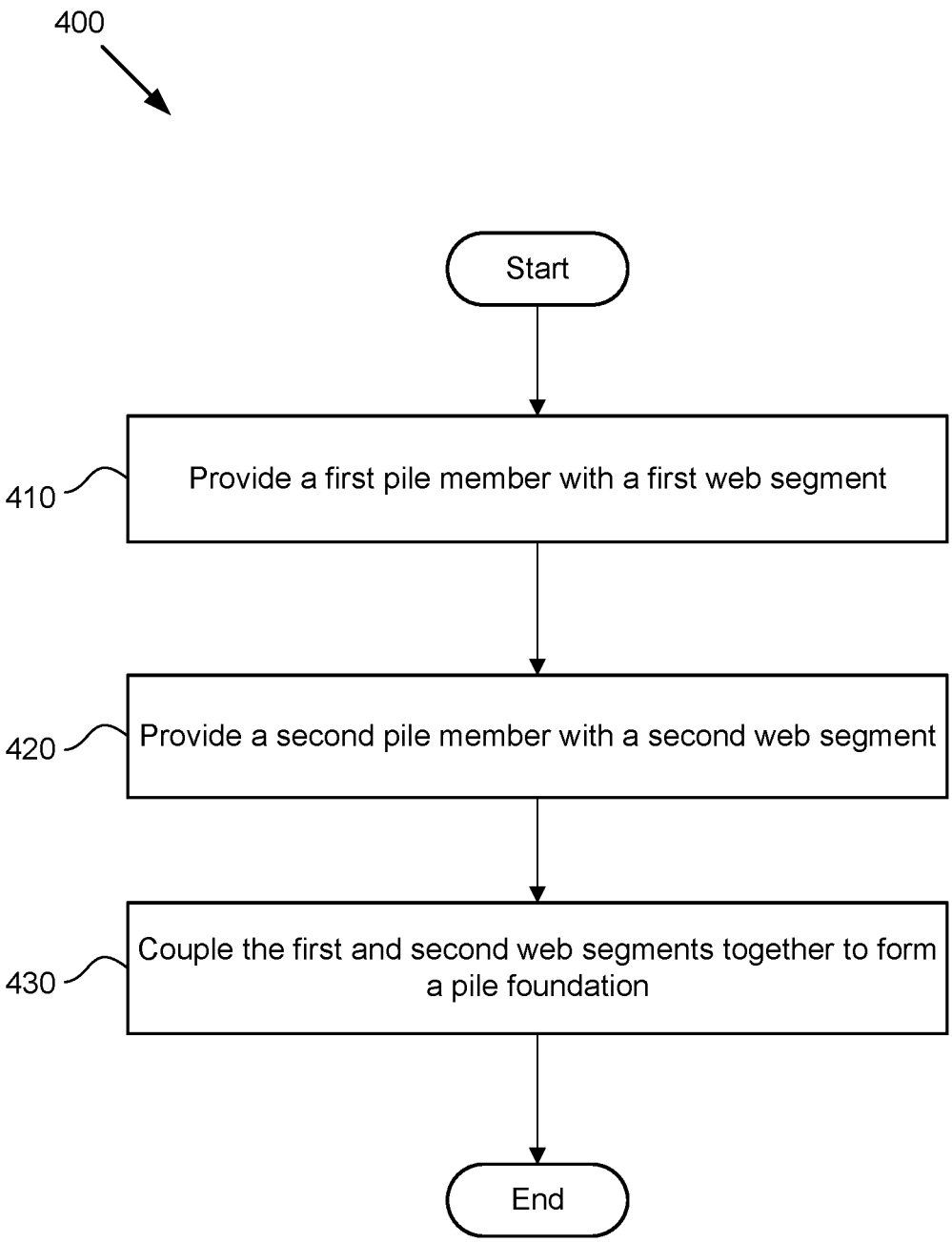
FIG. 4 is a schematic flowchart diagram of one embodiment of a method for manufacturing a foundation pile.

FIG. 4 is a schematic flowchart diagram of one embodiment of a method 400 for manufacturing a foundation pile 100. The method 400 includes providing a first pile member 110 that includes a first web segment 211, a first front flange segment 221, and a first rear flange segment 226 that form a monolithic one-piece construction at 410. The method 400 further includes providing a second pile member 120 that has a second web segment 216, a second front flange segment 222, and a second rear flange segment 227 that form a monolithic one-piece construction at 420. Providing these first and second pile members 110, 120 may include hot and/or cold rolling, as well as bending, metal sheets to have a desired shape. The method 400 further includes coupling the first web segment 211 of the first pile member 110 to the second web segment 216 of the second pile member 120 at 430. This coupling step may be accomplished by one or more of mechanically fastening, chemically bonding, and welding, among others.

Figure 5A:
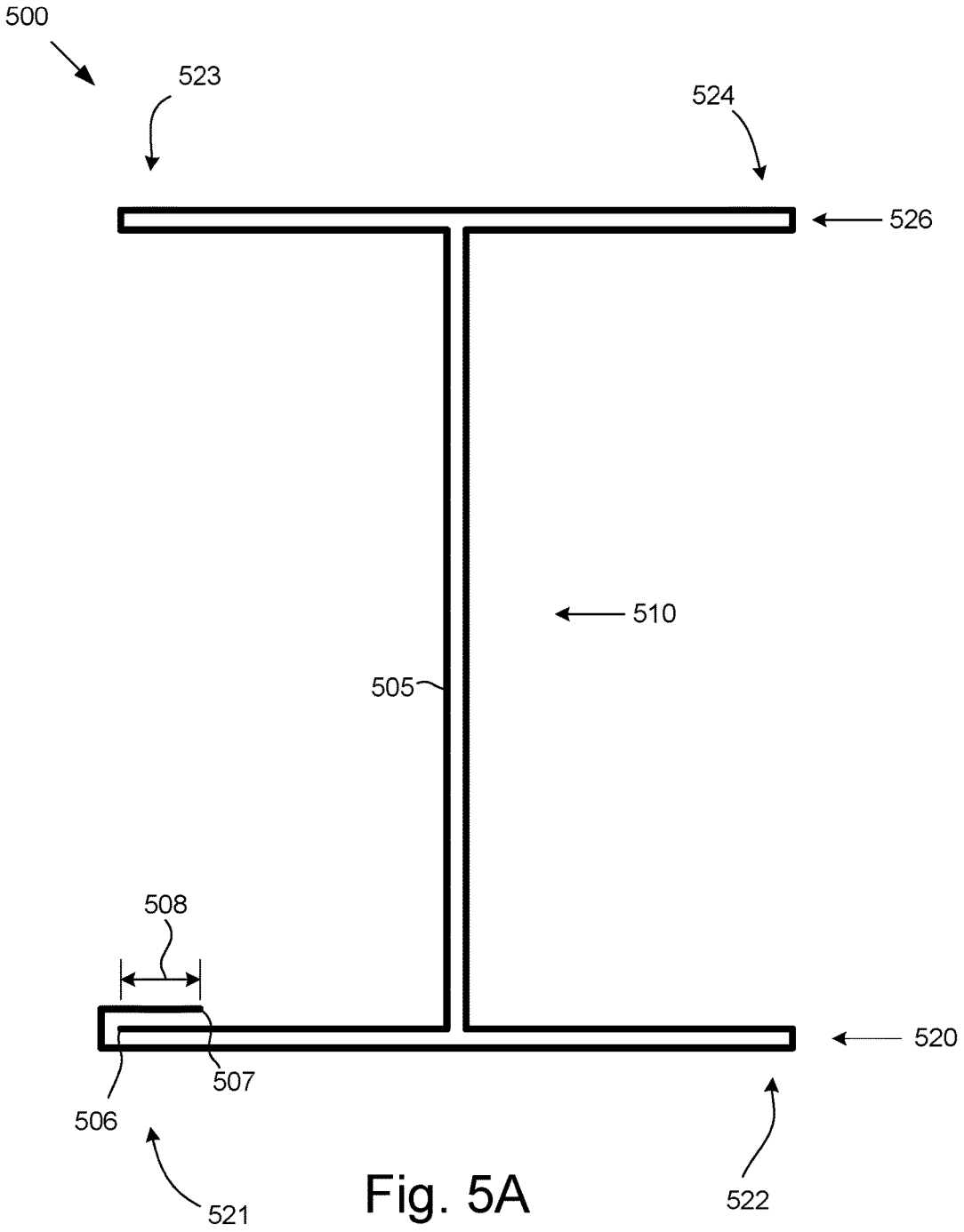
FIG. 5A is a schematic cross-sectional view of one embodiment of a foundation pile made without fasteners and made from a single, unitary structural material.

FIG. 5A is a cross-sectional view of one embodiment of a foundation pile 500 made without fasteners and made from a single, unitary structural material 505. For example, in one embodiment the unitary structural material is a continuous sheet of material (e.g., homogenous material). In one embodiment, a first end 506 of the unitary structural material 505 forms an edge of a first flange section 520. The unitary structural material 505 is configured to extend a distance from the first end 506 before it is bent to form a first layer of a web section 510 that extends between the first flange section 520 and a second flange section 526. The unitary structural material 505 is then rolled to form the double-layered second flange section 526. The unitary structural material 505 then extends back towards the first flange section 520, adjacent to the first layer of the web section 510, where the double-layered configuration of the first flange section 520 is formed.

However, the second end 507 of the unitary structural material 505, instead of terminating adjacent the first end 506, is wrapped around the first end 506 to form an overlapping region 508 where the flange has three layers. This overlapping region 508 holds the double layered structure of the foundation pile 500 together, without requiring fasteners, adhesives, bonding agents, or other such coupling means. Accordingly, since a substantial portion of both flange sections 520, 526 are double-layered, the foundation pile 500 is not constrained to be bent/configured in a certain direction (i.e., about the strong axis) and the foundation pile 500 has a substantially symmetric structural configuration.

In one embodiment, the first flange segment 520 has a first end portion 521 and a second end portion 522 and the second flange segment 526 has a third end portion 523 and a fourth end portion 524. According to one embodiment, the overlapping region 508 is at one of the first, second, third, and fourth end portions 521, 522, 523, 524.

Figure 5B:
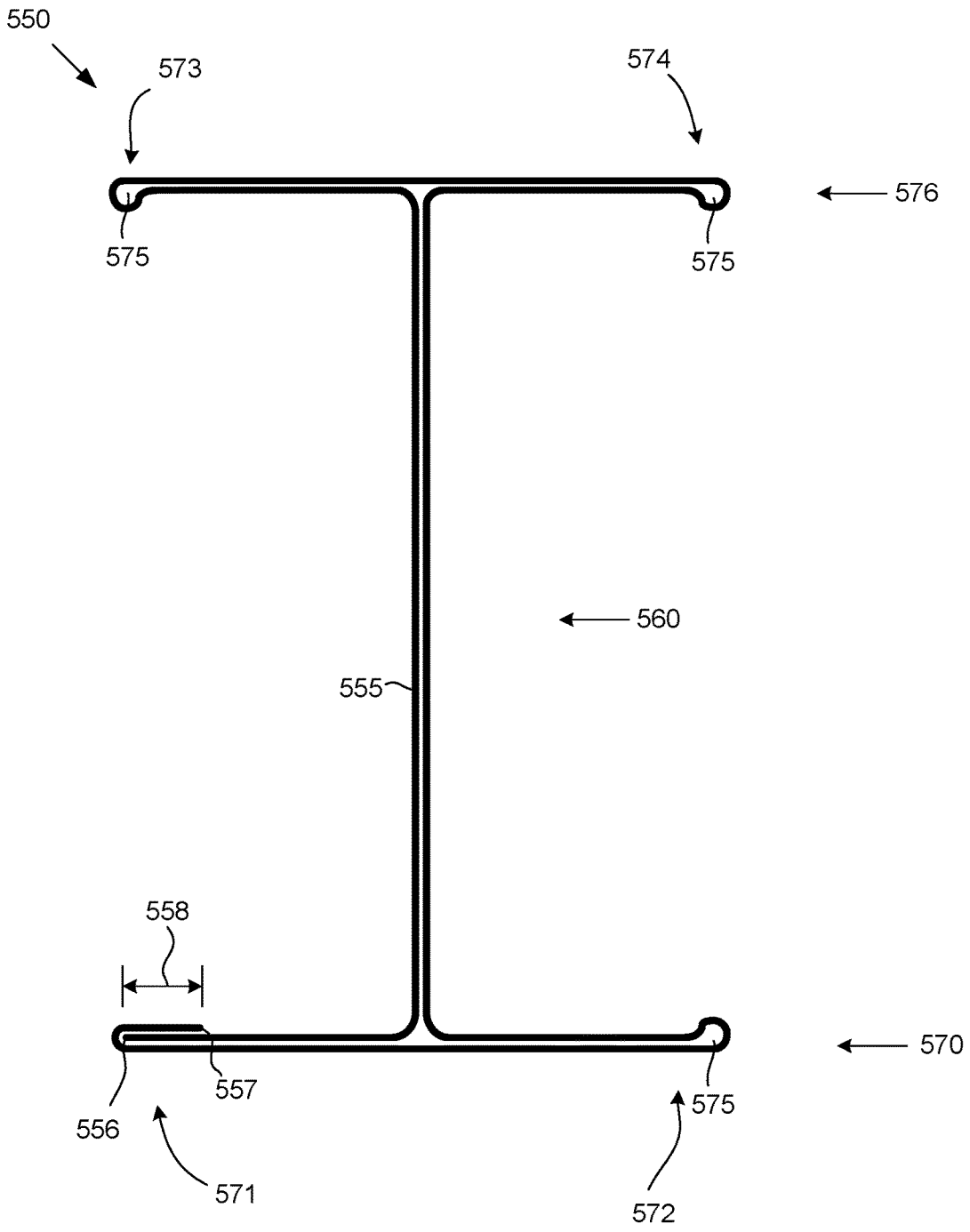
FIG. 5B is a schematic cross-sectional view of another embodiment of a foundation pile made without fasteners and from a single, unitary structural material.

FIG. 5B is a cross-sectional view of another embodiment of a foundation pile 550 made without fasteners, from a single, unitary structural material 555. For example, the foundation pile 550 is made from a continuous piece of material. As described above with reference to FIG. 5A, a first end 556 of the unitary structural material 555 is positioned at a first end portion 571 of a first flange section 570. The unitary structural material 555 is configured to extend a distance from the first end 556 before it is bent to form a first layer of a web section 560 that extends between the first flange section 570 and a second flange section 576. The unitary structural material 555 is then rolled to form the double-layered second flange section 576. From the second flange section 576, the unitary structural material 555 then extends back towards the first flange section 570, adjacent to the first layer of the web section 560, where the double-layered configuration of the first flange section 570 is formed. A second end 557 of the unitary structural material 555, instead of terminating adjacent the first end 556, is wrapped around the first end 556 to form an overlapping region 558 at the first end portion 571 of the first flange segment 570 where the flange has three layers. This overlapping region 558 holds the double layered structure of the foundation pile 550 together, without requiring fasteners, adhesives, bonding agents, or other such coupling means.

According to one embodiment, a bulbous region may is at one of the end portions 571, 572, 573, 574 of the flanges 570, 576. For example, in one embodiment, one of the end portions 571, 572, 573, 574 has a bulbous region 575 while another of the end portions 571, 572, 573, 574 has an overlapping region 558. In another embodiment, three of the end portions 571, 572, 573, 574 have a bulbous region while the remaining end portion of the end portions 571, 572, 573, 574 has the overlapping region 558. The bulbous region 575 is defined as an end portion 571, 572, 573, 574 of a flange segment that has a distance between the layers of material that is greater than the distance between layers of the material in the non-bulbous flange. In one embodiment, the bulbous regions 575 inhibit the cracking of coatings applied over the pile and improve the structural integrity of the foundation pile 550. In one embodiment, the radius of curvature of the bulbous regions 575 may not be as pronounced as shown in FIG. 5B. In other words, the bulbous regions 575 may be more like rounded corners than arcuate protrusions. In one embodiment, the bulbous regions 575 have a hollow center. The bulbous regions 575 at the end portions 571, 572, 573, 574 of the flanges 570, 576 may impart other benefits to the foundation pile 550, as will be recognized by those of ordinary skill in the art.

Figure 6A:
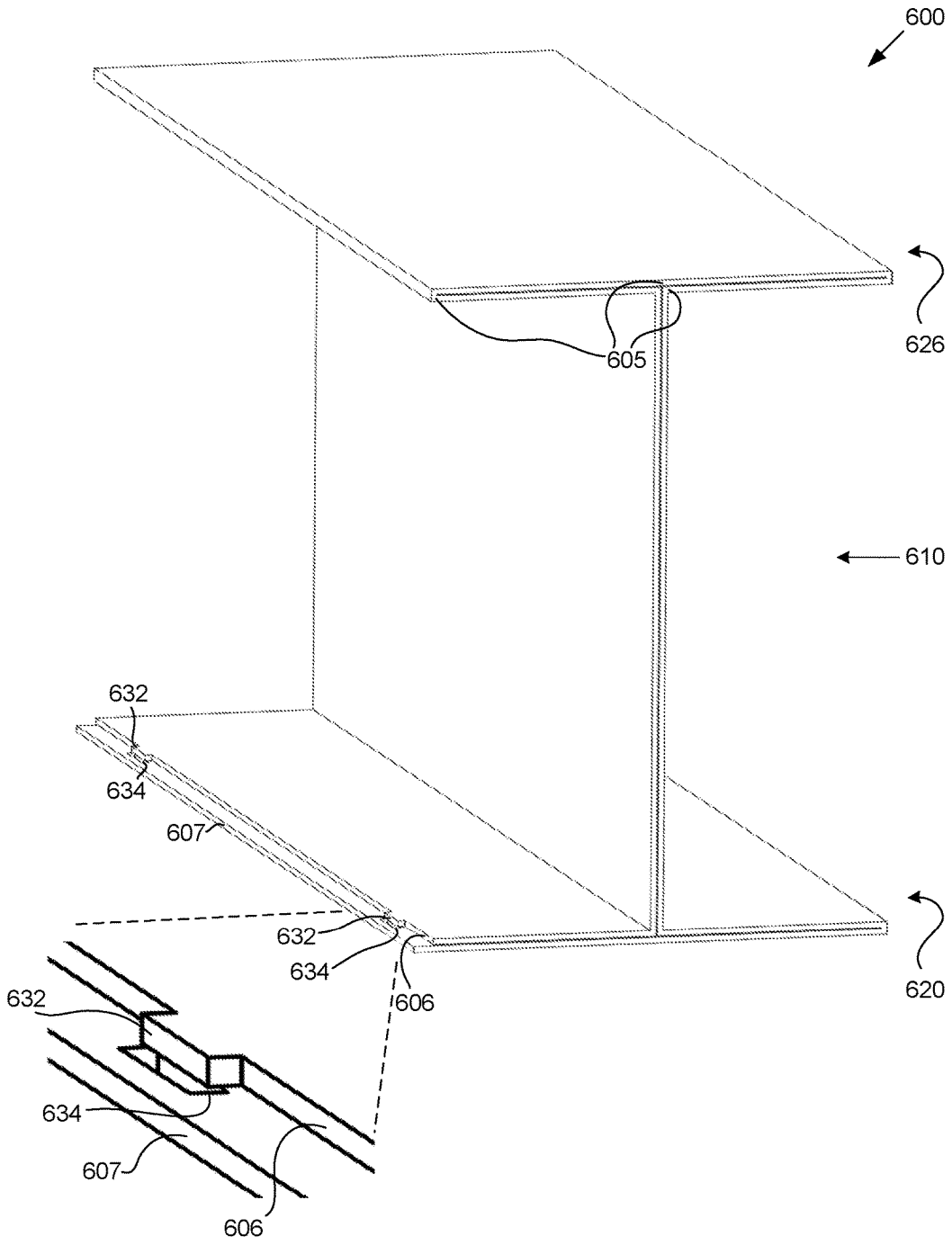
FIG. 6A is a schematic perspective view, including a magnified partial view, of one embodiment of a foundation pile made from a single, unitary structural material and having a complimentary tab-and-slot engagement in a flange section.
Figure 6B:
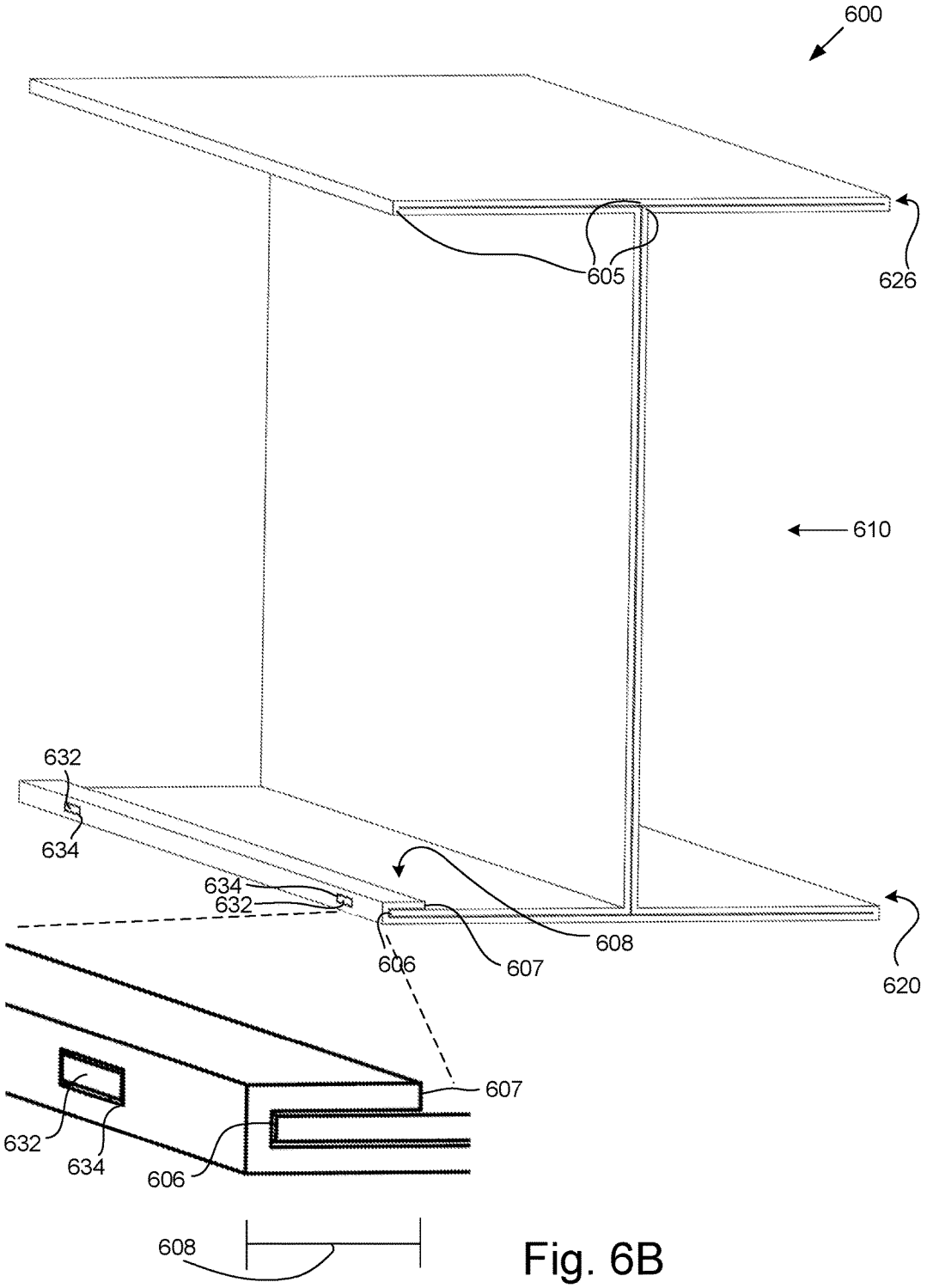
FIG. 6B is another schematic perspective view, including a magnified partial view, of the foundation pile of FIG. 6A.

FIG. 6A is a schematic perspective view, including a magnified partial view, of one embodiment of a foundation pile 600 made from a single, unitary structural material 605 and FIG. 6B is another schematic perspective view, including a magnified partial view, of the foundation pile 600 of FIG. 6A. The foundation pile 600 of FIGS. 6A and 6B includes multiple tab-and-slot features 632, 634 disposed in a first flange section 620 that improve the structural properties of the foundation pile. Similar to the embodiment of the foundation pile 500 described above with reference to FIG. 5A, the length of material 605 from which the foundation pile 600 is formed includes a first end 606 and a second end 607. The length of material 605 extending from the first end 606 forms a first layer of the first flange section 620. The material 605 is bent and thereafter forms a first layer of a web section 610 of the foundation pile. The first layer of the web section 610 extends between the first flange section 620 and a second flange section 626. The unitary structural material 605 is then bent/rolled to form the double-layered second flange section 626. The unitary structural material 605 then extends back towards the first flange section 620, forming a second layer of the web section 610 adjacent the first layer of the web section 610. The unitary structural material 605 is bent/rolled again to form a second layer of the first flange section 620. Thus, the entire foundation pile is double-layered.

The second end 607 of the unitary structural material 605, instead of terminating adjacent the first end 606, is wrapped around the first end 606 to form an overlapping region 608 where the first flange section 620 has three layers. One or more protruding tabs 632 extend from the first end 606 of the unitary material 605 and one or more respective slots 634 are formed in the unitary material 605 adjacent the second end 607. Upon wrapping the second end 607 around the first end 606, the tabs 632 are received into the slots 634 in order to improve the structural strength of the foundation pile. More specifically, the tab-and-slot engagement improves the transfer of shear flow in the web and flange sections 610, 620, 626.

Figure 7A:
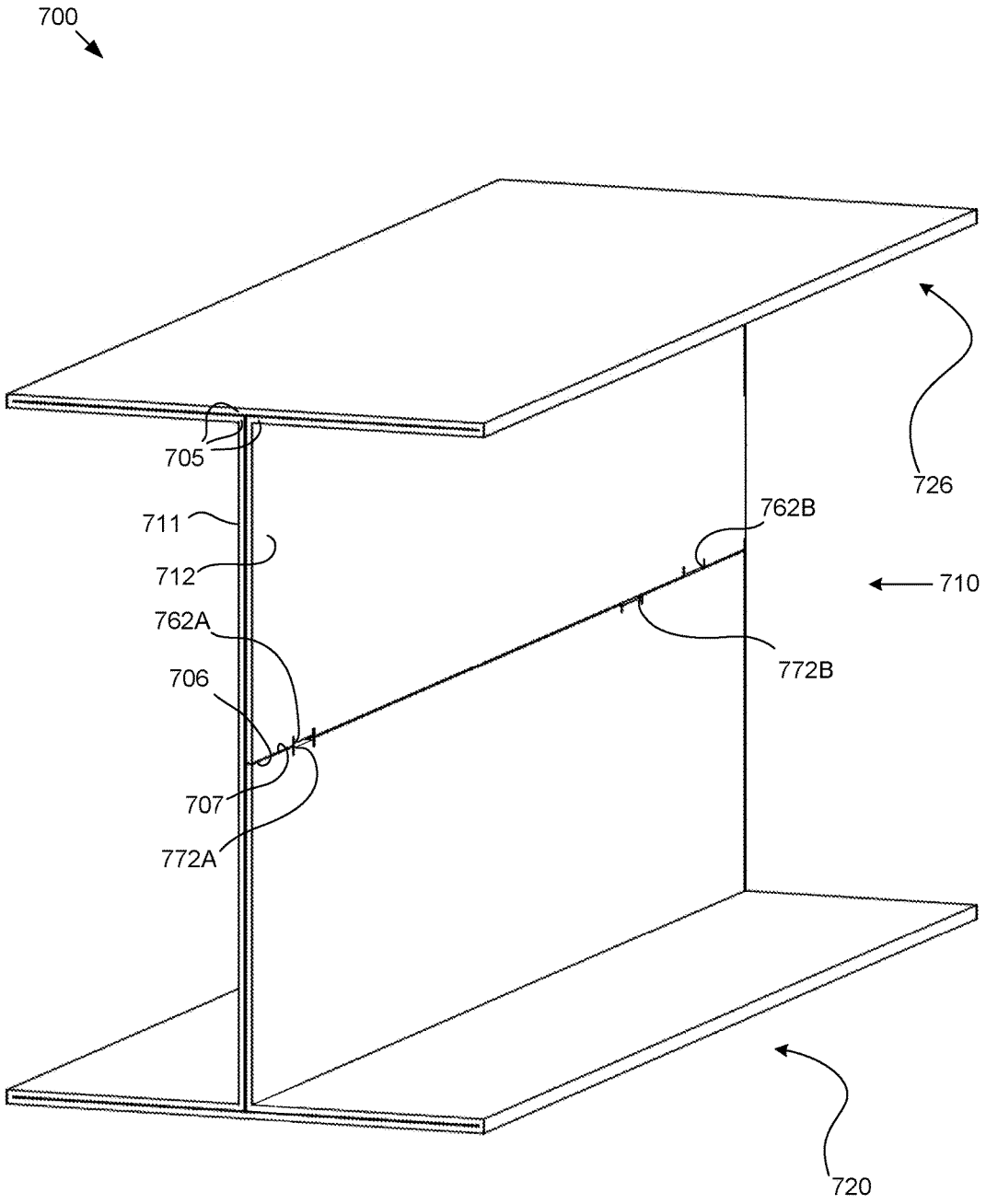
FIG. 7A is a schematic perspective view of one embodiment of a foundation pile made from a single, unitary structural material and having a complimentary tab-and-slot engagement in a web section.
Figure 7B:
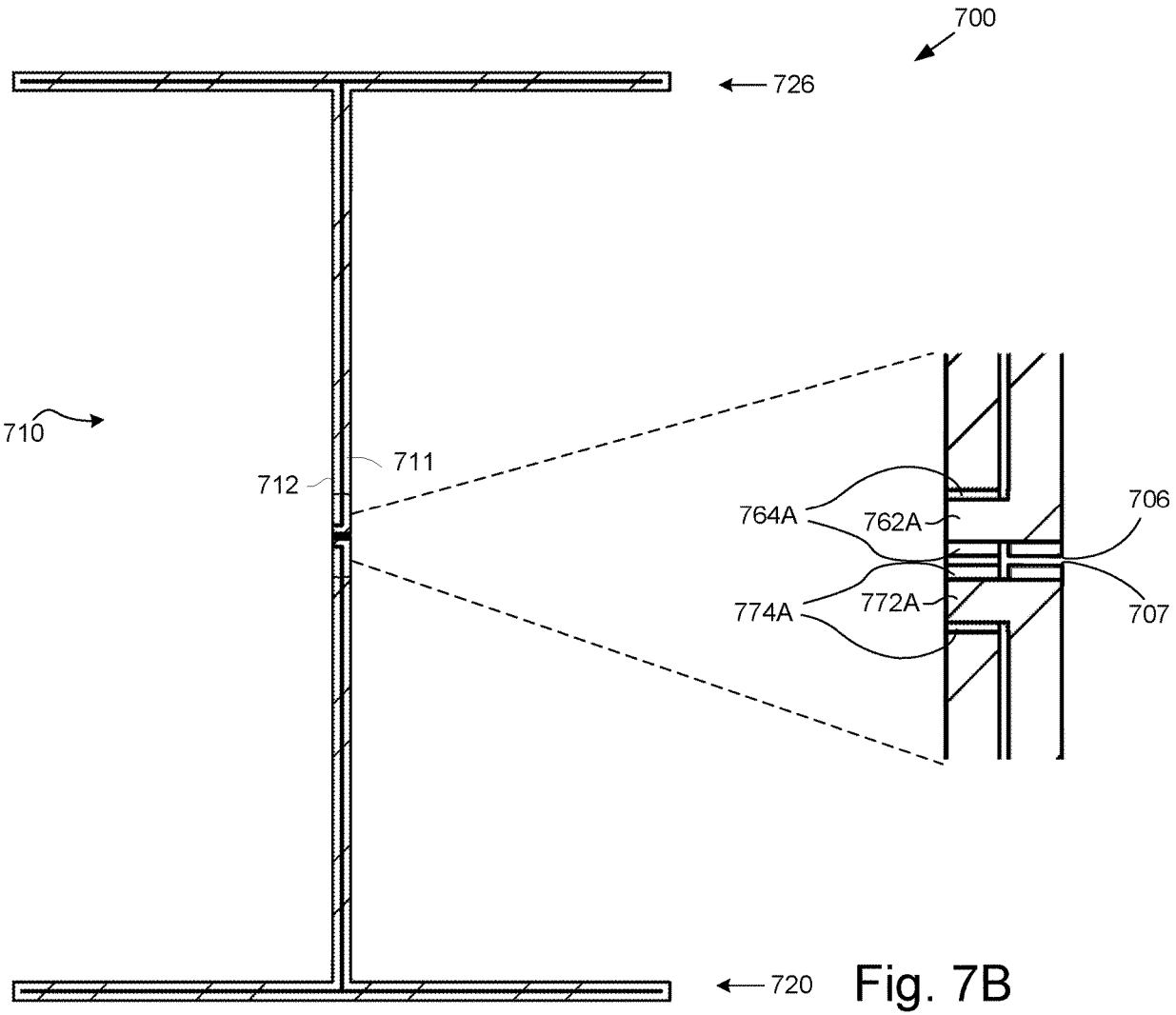
FIG. 7B is a schematic cross-sectional view, including a magnified partial view, of the foundation pile of FIG. 7A.

FIG. 7A is a schematic perspective view of one embodiment of a foundation pile 700 made from a single, unitary structural material 705 and FIG. 7B is a schematic cross-sectional view, including a magnified partial view, of the foundation pile of FIG. 7A. The unitary material 705 of the foundation pile 700 includes a first end 706 and a second end 707. The two ends 706, 707 of the unitary material 705 abut each other in the web section 710 of the foundation pile. In other words, the first and second ends 706, 707 abut each other in the web section 710 to form a first layer of the web section 710 and the unitary material 705 is bent and/or rolled to form the double layered flange sections 720, 726 and the second layer of the web section 710.

In one embodiment, as shown in FIGS. 7A and 7B, the ends 706, 707 of the length of material 705 have one or more tabs 762A, 772A, 762B, 772B that extend perpendicular relative to the web section 710 into respective slots 764A, 774A formed in a second layer 712 adjacent the first layer 711 of the at least two layers of the web section 710. In FIG. 7A, two different configurations of tabs/slots are shown. In one embodiment, the tabs 762A, 772A may be aligned with each other. In another embodiment, the tabs 762B, 772B may be staggered. It is expected that the number of tabs and respective slots may be dependent on the dimensions of the foundation pile and/or the anticipated or expected use of the foundation pile. Also, the location of the abutting ends 706, 707 along the length between the two flange sections 720, 726 may vary. For example, while the ends 706, 707 abut each other substantially at the halfway point between the two flange sections 720, 726 in the depicted embodiments, it is expected that in other embodiments the location of the abutting ends 706, 707 may relatively closer to one of the flange sections 720, 726.

In one embodiment, the tab-and-slot features of the foundation piles 600, 700 shown in FIGS. 6A-7B impart sufficient structure to the foundation piles 600, 700 that no chemical bonding agents, adhesives, or weldments are required to hold the two layers together. In one embodiment, the layers of the foundation pile are non-permanently fixed together. In other words, the layers of the foundation pile may be separable. In one embodiment, the foundation pile has an "I-shaped" cross-section (e.g., the foundation pile may resemble and I-beam).

Figure 8:
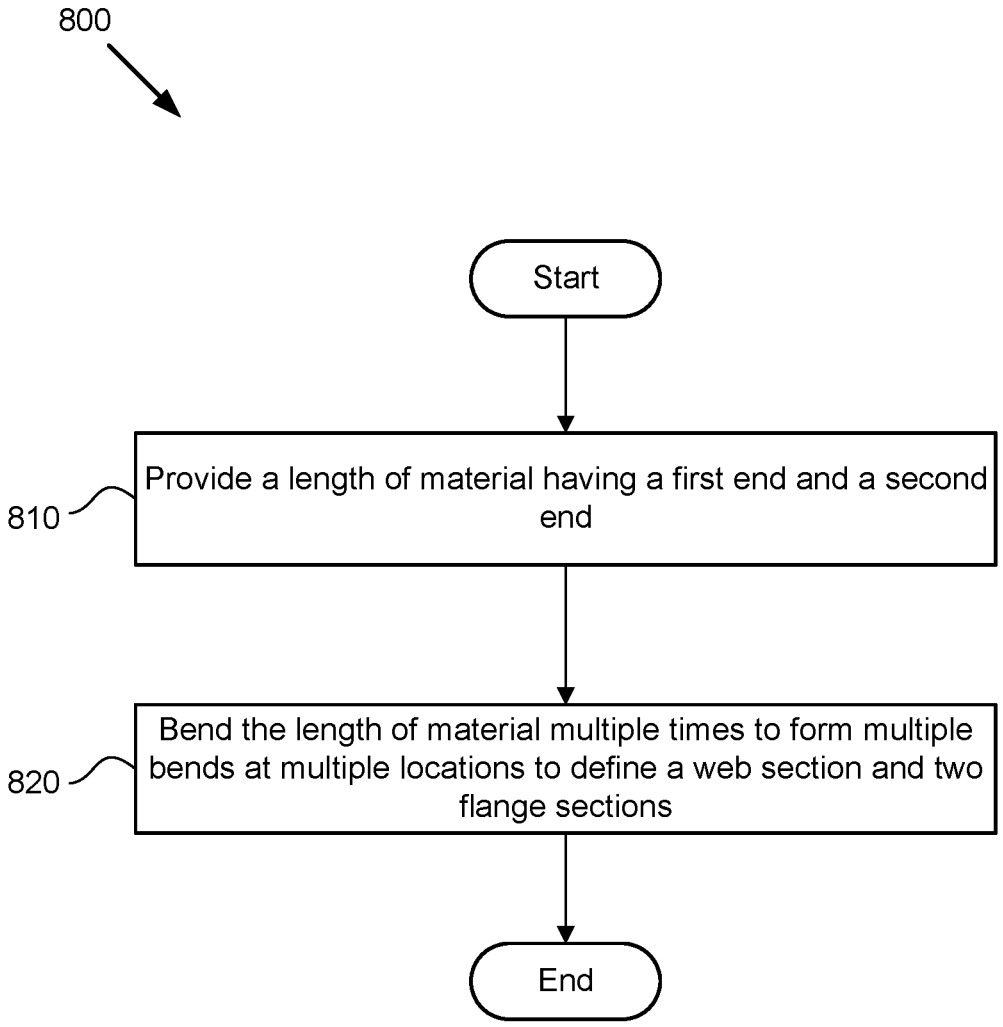
FIG. 8 is a schematic flow chart diagram of one embodiment of a method for manufacturing a foundation pile.

FIG. 8 is a schematic flowchart diagram of one embodiment of a method 800 for manufacturing a foundation pile. The method 800 includes providing a length of material having a first end and a second end at 810. The method 800 further includes bending the length of material multiple times to form multiple bends at different locations, thereby forming a foundation pile with a web section and two flange sections at 820. The web section and the two flange sections each has at least two layers of the length of material. The bending step of the method 800 may include bending the length of material 12 times to form 12 different bends at 12 different locations. For example, as shown in FIGS. 5A-6B, the single, unitary, continuous length of material can be bent 12 times to form the wrap-around/overlapping embodiment. In one embodiment, during one of the bending actions the method 800 may include inserted the tabs into respective slots, as shown in FIGS. 6A and 6B, to improve the strength of the foundation pile. Alternatively, as shown in FIGS. 7A and 7B, the single length of material can be bent 12 times to form a foundation pile with ends of the length of material abutting in the web section. In such an embodiment, the method 800 may further include bending the tabs (or alternatively inserting pre-bent tabs) into respective slots in an adjacent layer of the web section, as shown and described with reference to FIGS. 7A and 7B. The tabs and slots may be pre-formed in the length of material or the method 800 may include forming such elements.

Figure 9:
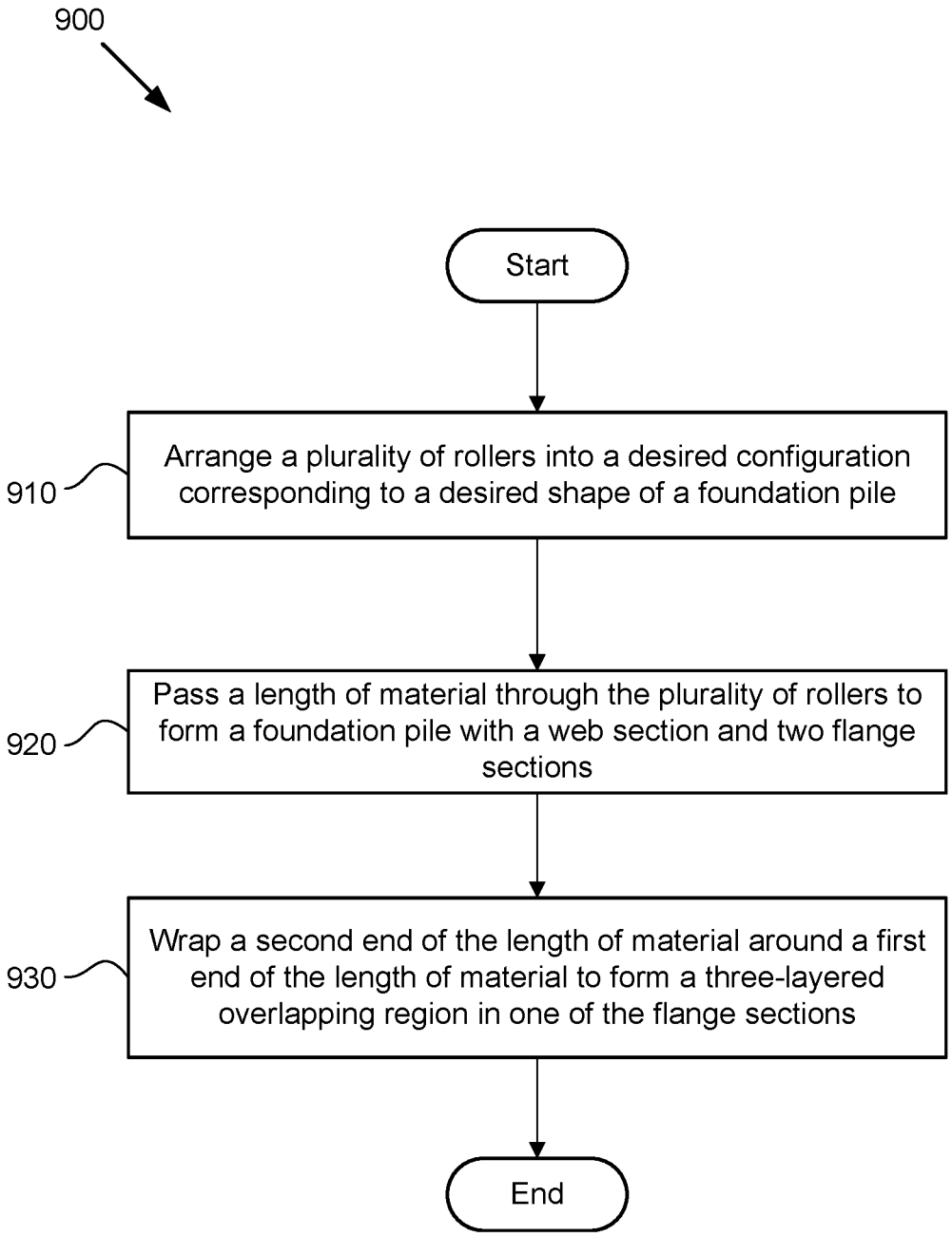
FIG. 9 is a schematic flowchart diagram of another embodiment of a method for manufacturing a foundation pile.

FIG. 9 is a schematic flowchart diagram of one embodiment of a method 900 for manufacturing a foundation pile. The method 900 includes arranging a plurality of rollers into a desired configuration corresponding to a desired shape of a foundation pile at 910. The plurality of rollers may form part of a roll-forming machine. The desired shape may be the shape shown in FIG. 5A, or other similar shape. The method 900 also includes passing a length of material through the plurality of rollers to form a foundation pile with a web section and two flange sections shaped according to the desired shape at 920. Then, the method 900 includes wrapping a second end of the length of material around a first end of the continuous length of material to form a three-layered overlapping region in one of the flange sections at 930. Wrapping the second end around the first end at 930 may occur after the length of material is formed into the desired shape. In some implementations, the foundation pile can be formed into the desired shape, and the second end of the length of material can be wrapped around the first end, using a different manufacturing process, such as a press-brake process or other similar process.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flowchart diagrams and/or schematic block diagrams in the Figures illustrate the architecture, functionality, and operation of possible implementations of apparatuses, systems, methods and computer program products according to various embodiments of the present invention. In this regard, each block in the schematic flowchart diagrams and/or schematic block diagrams may represent a module, segment, or portion of code, which comprises one or more executable instructions for implementing the specified logical function(s).

It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and computer instructions.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A foundation pile, comprising:

a first flange section;

a second flange section spaced apart from the first flange section; and a web section extending between the first and second flange sections;

wherein the first flange section, second flange section, and web section are formed from a single length of material, the first flange section, second flange section, and web section each comprising at least two layers of the material;

wherein a second end of the length of material is wrapped 180-degrees around a first end of the length of material to form a wrapped-around portion in the length of material and a three-layered overlapping region in the first flange section;

wherein one or more tabs protrude perpendicularly from the first end of the length of material, such that the tabs are not bent relative to the first end;

wherein the one or more tabs extend into respective one or more slots in the length of material adjacent the second end of the length of material; and wherein the respective one or more slots are formed in the wrapped-around portion.

2. The foundation pile of claim 1, wherein the first flange section comprises first and second end portions and the second flange section comprises third and fourth end portions, wherein the three-layered overlapping region is at one of the first, second, third, and fourth end portions.

3. The foundation pile of claim 1, wherein the foundation pile is free of a bonding agent between the layers of the material.

* * * * *